US006784627B2

(12) United States Patent
Suzuki et al.

(10) Patent No.: US 6,784,627 B2
(45) Date of Patent: Aug. 31, 2004

(54) DISCHARGE LAMP LIGHTING DEVICE TO LIGHT A PLURALITY OF DISCHARGE LAMPS

(75) Inventors: Shinichi Suzuki, Iwata-gun (JP); Yoshihito Suzuki, Iwata-gun (JP)

(73) Assignee: Minebea Co., Ltd., Kitasaku-gun (JP)

( * ) Notice: Subject to any disclaimer, the term of this patent is extended or adjusted under 35 U.S.C. 154(b) by 0 days.

(21) Appl. No.: 10/456,525

(22) Filed: Jun. 9, 2003

(65) Prior Publication Data

US 2004/0046512 A1 Mar. 11, 2004

(30) Foreign Application Priority Data

Sep. 6, 2002 (JP) ..... 2002-261246

(51) Int. Cl.[7] ..... H05B 39/00

(52) U.S. Cl. ..... 315/291; 315/277; 315/312; 315/224

(58) Field of Search ..... 315/291, 277, 315/276, 278, 220, 255, 224, 225, 312, 307

(56) References Cited

U.S. PATENT DOCUMENTS 3,287,601 A 11/1966 Collucci ..... 315/78
4,016,477 A * 4/1977 Ghiringhelli ..... 315/212
4,547,705 A * 10/1985 Hirayama et al. ..... 315/277
4,912,372 A * 3/1990 Mongoven et al. ..... 315/255
5,466,992 A * 11/1995 Nemirow et al. ..... 315/276
6,515,427 B2 * 2/2003 Oura et al. ..... 315/220

FOREIGN PATENT DOCUMENTS

EP 0 587 923 A1 3/1994
JP A 11-260580 9/1999

* cited by examiner

*Primary Examiner*—Don Wong
*Assistant Examiner*—Ephrem Alemu
(74) *Attorney, Agent, or Firm*—Oliff & Berridge, PLC

(57) ABSTRACT

A discharge lamp lighting device comprises a plurality of discharge lamps, at least one reflector, and at least one leakage transformer. Each leakage transformer lights three discharge lamps and comprises: a first leakage transformer, which comprises a frame-core shaped substantially rectangular and two bar-cores disposed parallel to each other and orthogonal to two opposing sides of the frame-core with a predetermined gap from the frame-core, has two of primary and secondary windings structurally independent of each other, and which lights two discharge lamps of the three; and a second leakage transformer, which comprises a frame-core shaped substantially like square-U letter and a bar-core disposed orthogonal to two opposing sides of the frame-core with a predetermined gap from the frame-core, has one primary and secondary winding structurally independent of each other, and which lights remaining one discharge lamp.

10 Claims, 7 Drawing Sheets

Fig. 5

| | Coil 1 | | Coil 2 | |
|---|---|---|---|---|
| | Wire connection 1 | Wire connection 2 | Wire connection 1 | Wire connection 2 |
| | 5.79 | 6.21 | 5.34 | 5.86 |
| IL2 | 6.44 | 6.29 | 6.08 | 5.99 |
| IL3 | 5.28 | 4.78 | 6.15 | 5.91 |
| IL4 | 5.91 | 6.10 | 5.45 | 5.73 |
| IL5 | 6.69 | 6.31 | 6.32 | 5.94 |
| IL6 | 5.19 | 5.15 | 6.05 | 5.90 |
| Vop1 | 1034 | | 964 | |
| Vop2 | 1022 | | 916 | |
| Vop3 | 1060 | | 1092 | |
| Vop4 | 1000 | | 962 | |
| Vop5 | 1066 | | 958 | |
| Vop6 | 1064 | | 1096 | |
| Phase difference 1 | 1.24μs | 0.12μs | 1.56μs | 0.44μs |
| Phase difference 2 | 1.16μs | 0.12μs | 1.48μs | 0.44μs |

DISCHARGE LAMP LIGHTING DEVICE TO LIGHT A PLURALITY OF DISCHARGE LAMPS

BACKGROUND OF THE INVENTION

1. Field of the Invention

The present invention relates to a discharge lamp lighting device which, as a backlight source for a large liquid crystal display device, lights a plurality of discharge lamps.

2. Description of the Related Art

A discharge lamp lighting device with a high-frequency lighting circuit has been proposed which lights cold cathode discharge lamps as a backlight source for a large liquid crystal display device. FIG. 6 shows such a discharge lamp lighting device, in which light rays emitted from a plurality (six in the figure) of cold cathode discharge lamps L1 to L6 are adapted to illuminate a liquid crystal display device by means of reflectors R and a light guiding plate PL disposed between the reflectors R. FIGS. 7 and 8 are block diagrams of conventional discharge lamp lighting devices described with reference to FIG. 6. Referring to FIG. 7, each lighting circuit LC comprises: a control circuit CT; a driving circuit D driven by the control circuit CT; a leakage transformer T; a discharge lamp L; and a resistor R1 connected in series to the discharge lamp L, and one lighting circuit LC is provided with each discharge lamp. Referring to FIG. 8, a lighting circuit LC comprises: a control circuit CT; a driving circuit D driven by the control circuit CT; a leakage transformer T; three ballast capacitors CB connected in parallel with one another; three discharge lamps L connected in parallel with one another and in series to respective ballast capacitors CB; and a resistor R1 connected in series to the three discharge lamps L.

The control circuit CT receives a DC power supply V, outputs a predetermined AC signal, detects a tube current flowing from the resistor R1 to the discharge lamps L, and controls the oscillation amplitude of the driving circuit D. In the discharge lamp lighting device shown in FIG. 7, one discharge lamp L requires one high-voltage and high-frequency transformer therefore requiring a plurality of transformers, and the plurality of transformers must be regulated so that tube currents in respective discharge lamps L are equal to one another. In the discharge lamp lighting device shown in FIG. 8, high-voltage and high-current capacitors are required, and the discharge lamps L have their lighting frequencies increased to, for example, 50 kHz for stable lighting operation. As a result, stray capacitances CS present between the reflectors R and the cold cathode discharge lamps L1 to L6 and present between the cold cathode discharge lamps L1 to L6 (see FIG. 6) make an impact, whereby tube currents in the discharge lamps change thus generating variance in illuminance.

To overcome the above problem, a discharge lamp lighting device shown in FIG. 9 for lighting a plurality of discharge lamps was disclosed in Japanese Patent Application Laid-open No. Hei 11-260580. The discharge lamp lighting device comprises: a DC power supply 31; and first and second switching elements (FETs) 12 and 13 which are connected in series to each other and which are connected respectively to one end and the other end of the DC power supply 31. A first series resonant circuit 15 consisting of an inductor 15*a* and a first capacitor 17 is connected to the connection between the first and second switching elements 12 and 13 and to the other end of the DC power supply 31. And a second capacitor 15*b* is connected to the connection between the inductor 15*a* and the first capacitor 17 and to the other end of the DC power supply 31. The discharge lamp lighting device further comprises: a second series circuit consisting of a first discharge lamp 18 and a first resistor 19; and a first control circuit 14 to control the switching frequencies of the first and second switching elements 12 and 13 in order to equalize the current in the first discharge lamp 18 to a predetermined value.

A second series resonant circuit 20 consisting of a variable inductor 21*a* and a third capacitor 22 is connected to the connection between the first and second switching elements 12 and 13 and to the other end of the DC power supply 31. A series circuit consisting of a fourth capacitor 10, a second discharge lamp 11, and a second resistor 23*a* to detect current is connected to the connection between the variable inductor 21*a* and the third capacitor 22 and to the other end of the DC power supply 31. A second control circuit 23 is provided which controls the inductance of the variable inductor 21*a* thereby equalizing the current in the second discharge lamp 11 to a predetermined value. For lighting a plurality of discharge lamps, there are provided a plurality of second series resonant circuits 20 each consisting of the variable inductor 21*a* and the third capacitor 22, a plurality of series circuits each consisting of the fourth capacitor 10, the second discharge lamp 11 and the second resistor 23*a* to detect current, and plurality of second control circuits 23.

The FETs 12 and 13 as switching elements are alternately switched on and off by respective control signals supplied from the first control circuit 14 comprising a microcomputer, and so on to respective gates of the FETs. The first control circuit 14 is capable of controlling the frequency of the control signal across a predetermined range. The connection between a source S of the FET 12 and a drain D of the FET 13 is connected to a cathode of the DC power supply 31 via the series circuit consisting of the inductor 15*a* constituting the first series resonant circuit 15 and the second capacitor 15*b*, and the inductance of the inductor 15*a* and the capacitance of the capacitor 15*b* are set to respective predetermined values so as to set a resonant frequency f0 of the first series resonant circuit 15 to a predetermined frequency.

The above discharge lamp lighting devices have the following problem. Since the inductance value of the variable capacitor 21*a* is controlled so that the current of the second discharge lamp 11 is equal to a predetermined value, the second control circuit 23 for controlling the inductance value is required. Further, for lighting a plurality of discharge lamps, there must be provided a plurality of second series resonant circuits 20 each consisting of the variable inductor 21*a* and the third capacitor 22, a plurality of series circuits each consisting of the fourth capacitor 10, the second discharge lamp 11 and the second resistor 23*a* to detect current, and plurality of second control circuits 23. Accordingly, for example, if six discharge lamps are lighted as shown in FIG. 6, its circuit has to be complicated and the number of the components is inevitably increased, thereby making it difficult to realize cost reduction. Also, the increased number of the components tends to degrade the reliability of the device.

SUMMARY OF THE INVENTION

The present invention has been made in light of the above problem, and it is an object of the present invention to provide a reliable discharge lamp lighting device, which uses a limited number of components, and which is capable of lighting a plurality of discharge lamps without suffering the effects of stray capacitances present between and around the discharge lamps.

In order to achieve the above object, according to a first aspect of the present invention, a discharge lamp lighting device comprises a plurality of discharge lamps, at least one reflector to reflect light rays emitted from the discharge lamps, and at least one leakage transformer, and each leakage transformer is adapted to light three discharge lamps, and comprises: a first leakage transformer, which has two primary windings and two secondary windings structurally independent of the two primary windings, and is adapted to light two discharge lamps of the three; and a second leakage transformer, which has a primary winding and a secondary winding structurally independent of the primary winding, and is adapted to light remaining one discharge lamp of the three.

According to a second aspect of the present invention, in the discharge lamp lighting device of the first aspect, the plurality of discharge lamps are disposed in parallel with one another, and the one discharge lamp lighted by the second leakage transformer is located between the two discharge lamps lighted by the first leakage transformer.

According to a third aspect of the present invention, in the discharge lamp lighting device of the first aspect, the first and second leakage transformers are driven by the same driving circuit, and three discharge lamps are lighted in-phase with one another.

According to a fourth aspect of the present invention, in the discharge lamp lighting device of the first aspect, the numbers of turns on the primary and secondary windings of the second leakage transformer are determined so as to equalize respective currents flowing in the three discharge lamps when the discharge lamps are lighted.

According to a fifth aspect of the present invention, in the discharge lamp lighting device of any one of the first to fourth aspects, the numbers of turns on the primary windings of the first leakage transformer are equal to each other and the numbers of turns on the secondary windings of the first leakage transformer are equal to each other.

According to a sixth aspect of the present invention, in the discharge lamp lighting device of the first aspect, the first leakage transformer comprises: a frame-core shaped substantially rectangular; and two bar-cores disposed parallel to each other and orthogonal to two opposing sides of the frame-core with a predetermined gap from the frame-core, and each bar-core having a primary winding and a secondary winding structurally independent of the primary winding, and the second leakage transformer comprises: a frame-core shaped substantially like square-U letter; and a bar-core disposed orthogonal to two opposing sides of the frame-core with a predetermined gap from the frame-core, and having a primary winding and a secondary winding structurally independent of the primary winding.

According to a seventh aspect of the present invention, in the discharge lamp lighting device of the first aspect, the first leakage transformer comprises: a frame-core shaped substantially rectangular; and two bar-cores disposed parallel to each other and orthogonal to two opposing sides of the frame-core with a predetermined gap from the frame-core, and each (bar-core) having a primary winding and a secondary winding structurally independent of the primary winding, and the second leakage transformer comprises: a frame-core shaped substantially rectangular; and a bar-core disposed orthogonal to two opposing sides of the frame-core with a predetermined gap from the frame-core, and having a primary winding and a secondary winding structurally independent of the primary winding.

Accordingly, the discharge lamp lighting device of the present invention can be provided, which can be produced with a limited number of components, at a low cost, with a high reliability, and which can light a plurality of discharge lamps without suffering the influence of stray capacitances present between and around the discharge lamps.

BRIEF DESCRIPTION OF THE DRAWINGS

FIG. 5 is a table showing experimental results on the discharge lamp lighting device of FIG. 4;

DETAILED DESCRIPTION OF THE PREFERRED EMBODIMENTS

Preferred embodiments will now be described with reference to the accompanying drawings. A discharge lamp lighting device of the present invention comprises a first leakage transformer T1 of FIGS. 1A, 1B and 1C, and a second leakage transformer T2 of FIGS. 2A, 2B and 2C.

Figure 1A:
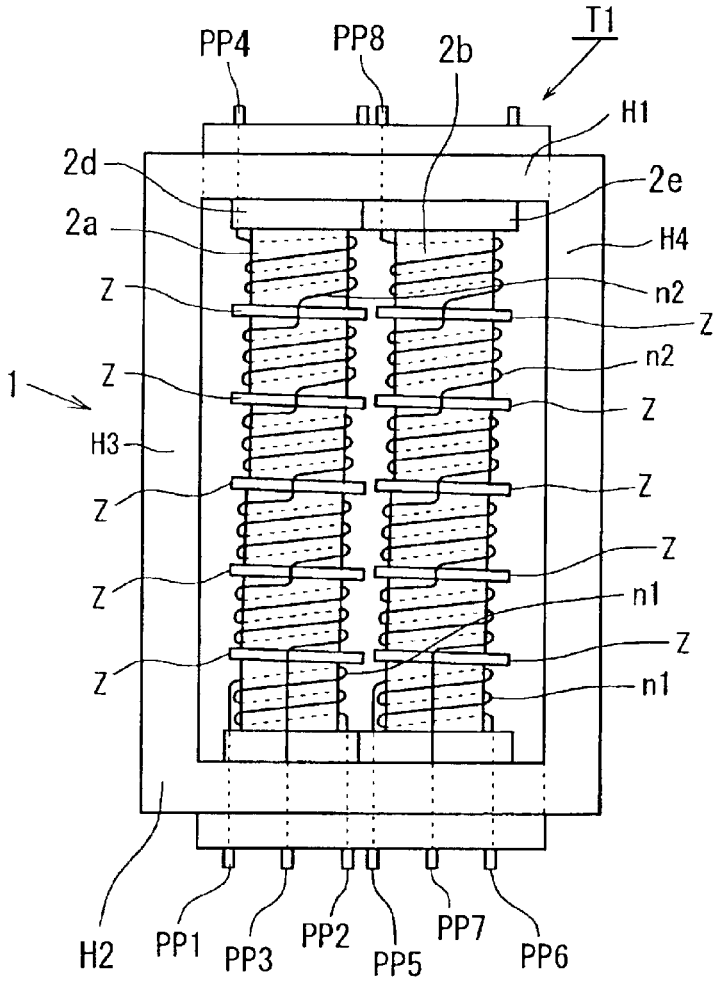
FIGS. 1A, 1B and 1C are views of a first leakage transformer of a discharge lamp lighting device of the present invention, respectively showing its front view, right side view and bottom view.
Figure 1B:
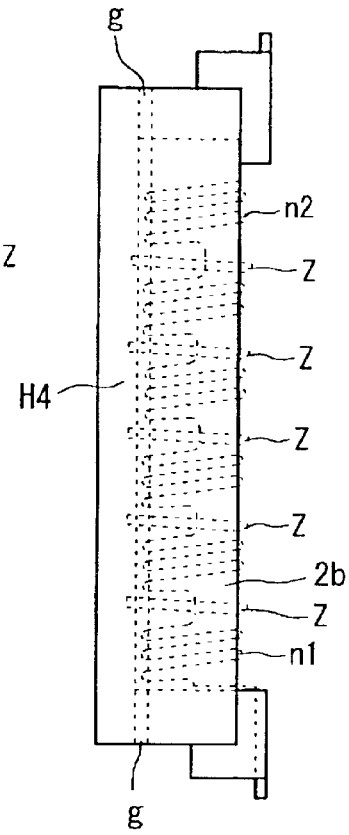
Figure 1C:
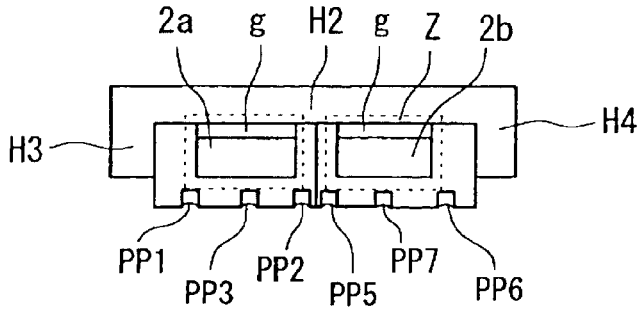

Referring to FIG. 1A, the first leakage transformer T1 comprises a frame-core 1, and two bar-cores 2*a* and 2*b*. The frame-core 1 is shaped substantially rectangular, includes four sides, specifically two shorter sides H1 and H2 and two longer sides H3 and H4, and has a larger thickness at the longer sides H3 and H4 than at the shorter sides H1 and H2 as shown in FIG. 1C. The bar-cores 2*a* and 2*b* are inserted in respective bobbins 2*d* and 2*e* each having therearound primary and secondary windings n1 and n2. Primary and secondary winding n1 and n2 provided around the bobbin 2*d* are structurally independent of each other, and primary and secondary windings n1 and n2 provided around the bobbin 2*e* are structurally independent of each other. Two primary windings n1 and n1 provided around the respective bobbins 2*d* and 2*e* are in-phase with each other, and two secondary windings n2 and n2 provided around the respective bobbins 2*d* and 2*e* are in-phase with each other. The bobbins 2*d* and 2*e* each include, at the secondary winding n2, a plurality of separators Z for preventing dielectric breakdown. The bar-cores 2*a* and 2*b* inserted respectively in the bobbins 2*d* and 2*e* are disposed parallel with each other and orthogonal to the shorter sides H1 and H2 of the frame-core 1 such that the bobbins 2*d* and 2*e* are adhesively fixed to the frame-core 1 with a predetermined gap g (for example, about 25 $\mu$m) secured by an insulation film placed between the bar-cores 2*a* and 2*b* and the shorter sides H1 and H2 of the frame-core 1 as shown in FIGS. 1B and 1C.

The both ends of each of the bar-cores 2*a* and 2*b* are exposed at the both ends of the bobbins 2*d* and 2*e* and go across the shorter sides H1 and H2 of the frame-core 1. The bobbin 2*d* has terminals PP1, PP2, PP3 and PP4, and the bobbin 2*e* has terminals PP5, PP6, PP7 and PP8. On the bobbin 2*d*, the first winding n1 is connected to the terminals PP1 and PP2, and the second winding n2 is connected to the terminals PP3 and PP4. On the bobbin 2*e*, the primary winding n1 is connected to the terminals PP5 and PP6, and the secondary winding n2 is connected to the terminals PP7 and PP8.

Figure 2A:
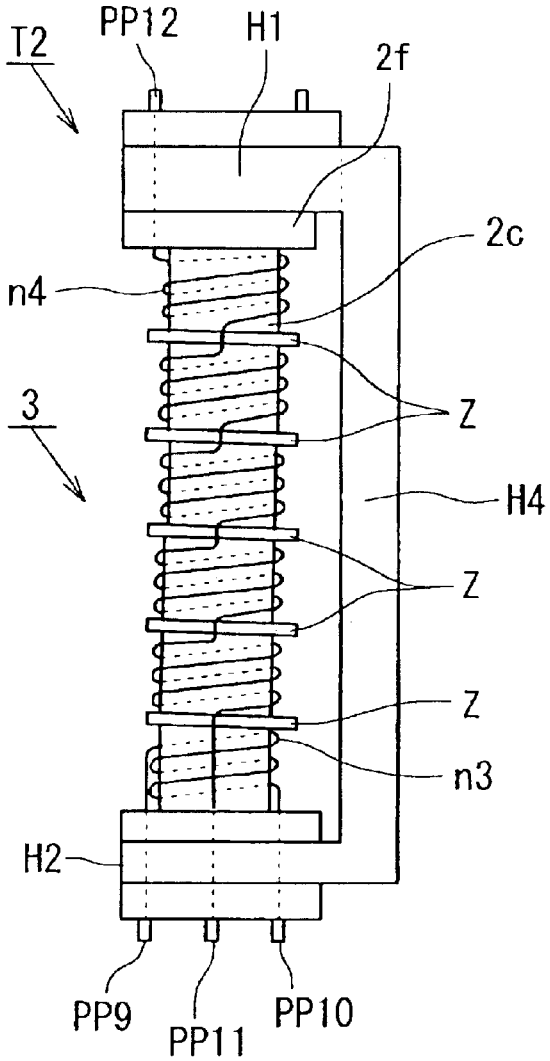
FIGS. 2A, 2B and 2C are views of a second leakage transformer of a discharge lamp lighting device according to a first embodiment of the present invention, respectively showing its front view, right side view and bottom view.

Referring to FIG. 2A, the second leakage transformer T2 comprises a frame-core 3, and a bar-core 2*c*. The frame-core 3 is shaped substantially like square-U letter, includes three sides, specifically two shorter sides H1 and H2 and one longer side H4, and has a larger thickness at the longer side H4 than at the shorter sides H1 and H2 as shown in FIG. 2C. The bar-core 2*c* is inserted in a bobbin 2*f* having therearound primary and secondary windings n3 and n4 which are structurally independent of each other. The bobbin 2*f* includes, at the secondary winding n4, a plurality of separators Z for preventing dielectric breakdown. The bar-core 2*c* inserted in the bobbin 2*f* is disposed orthogonal to the shorter sides H1 and H2 of the frame-core 3 such that the bobbin 2*f* is adhesively fixed to the frame-core 3 with a predetermined gap g (for example, about 25 $\mu$m) secured by an insulation film placed between the bar-core 2*c* and the shorter sides H1 and H2 of the frame-core 3 as shown in FIGS. 2B and 2C.

The both ends of the bar-core 2*c* are exposed at the both ends of the bobbin 2*f* and go across the shorter sides H1 and H2 of the frame-core 3. The bobbin 2*f* has terminals PP9, PP10, PP11 and PP2. The primary winding n3 is connected to the terminals PP9 and PP10, and the secondary winding n4 is connected to the terminals PP11 and PP12.

The first leakage transformer T1 is adapted to light two discharge lamps, and the second leakage transformer T2 is adapted to light one discharge lamp, as discussed later.

Figure 2B:
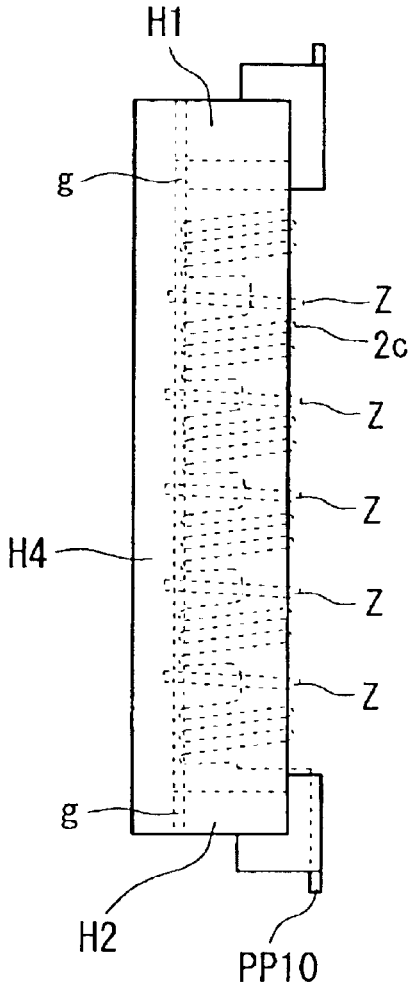
Figure 2C:
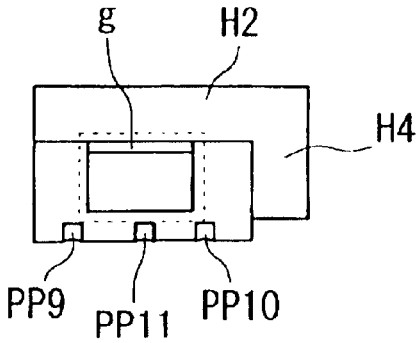
Figure 3A:
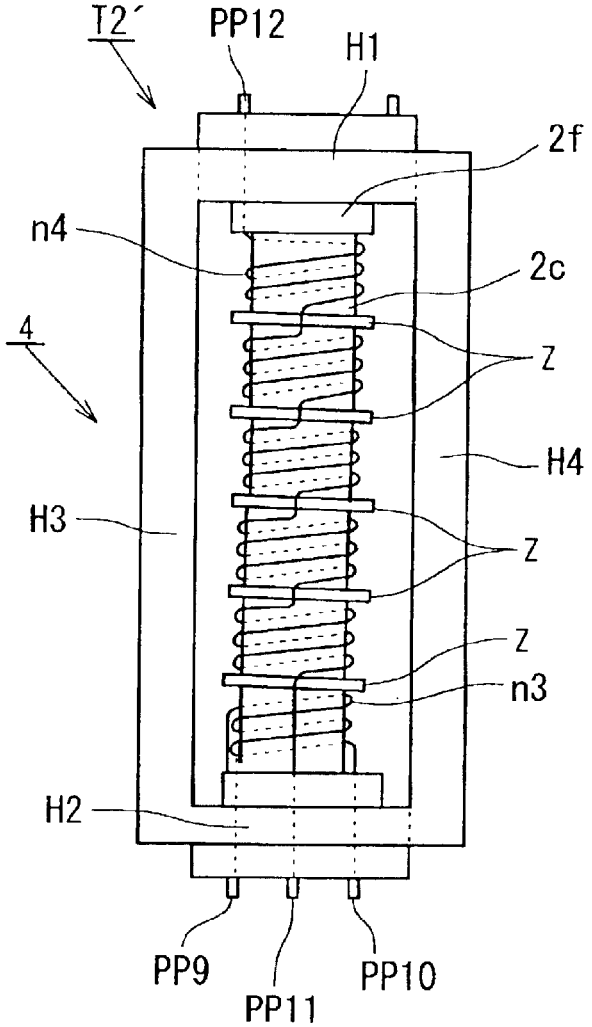
FIGS. 3A, 3B and 3C are views of a second leakage transformer of a discharge lamp lighting device according to a second embodiment of the present invention, respectively showing its front view, right side view and bottom view.
Figure 3B:
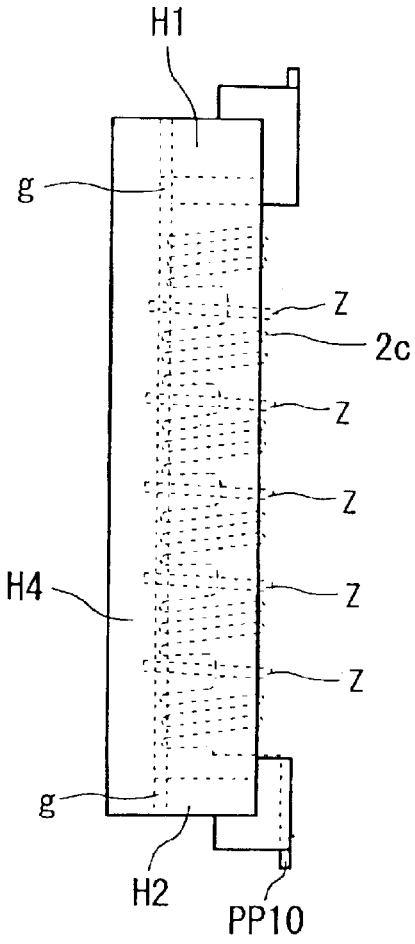
Figure 3C:
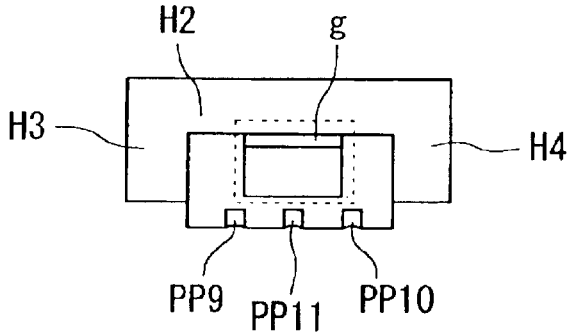

FIGS. 3A, 3B and 3C show another second leakage transformer T2', which is identical with the second leakage transformer T2 described in FIGS. 2A, 2B and 2C except its frame-core configuration. Specifically, the second leakage transformer T2' has a frame-core 4 shaped substantially rectangular and including four sides H1, H2, H3 and H4 like the frame-core 1 of the first leakage transformer T1 of FIGS. 1A, 1B and 1C. Otherwise, the second leakage transformer T2' has the same structure as the second leakage transformer T2, and the detailed description thereof will be omitted.

In the second leakage transformer T2', since magnetic paths are formed on both sides of the bar-core 2*c*, its magnetic flux density can be doubled when sized and configured identically with the second leakage transformer T2. Further, the second leakage transformer T2' is well balanced in structure compared with the second leakage transformer T2, therefore can be fabricated more easily, and produces stable characteristics. And if the first and second leakage transformer T1 and T2' use a frame-core in common, the number of components can be decreased, whereby the cost can be reduced and the reliability can be enhanced.

Figure 4:
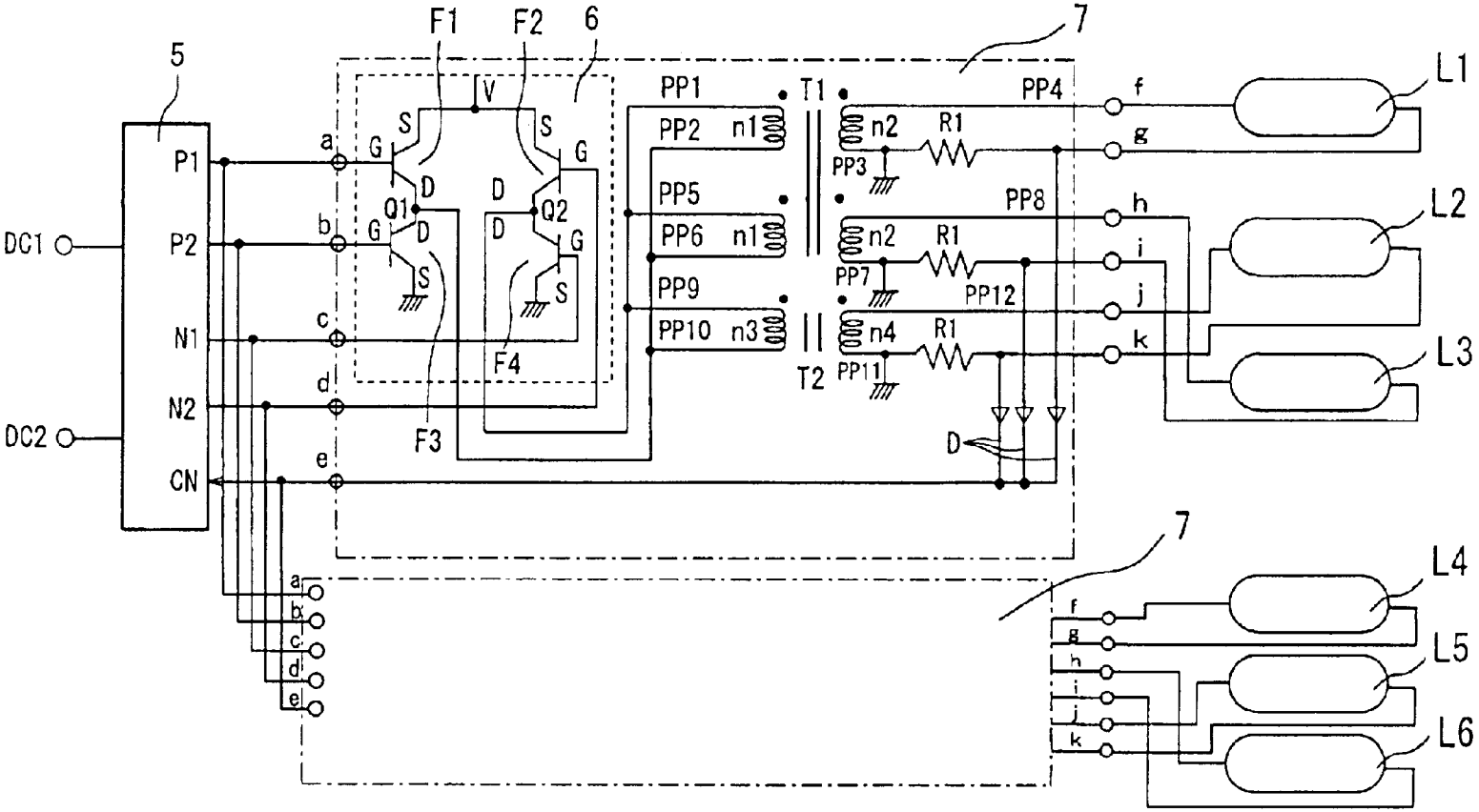
FIG. 4 is a circuit diagram of the discharge lamp lighting device of the present invention comprising the first and second leakage transformers.

Referring to FIG. 4, a discharge lamp lighting device comprises the first leakage transformer T1 and the second leakage transformer T2. A cold cathode discharge lamp L1 has its both ends connected respectively to output terminals f and g of a lighting circuit 7, a cold cathode discharge lamp L2 has its both ends connected respectively to output terminals h and j, and a cold cathode discharge lamp L3 has its both ends connected respectively to output terminals j and k. The lighting circuit 7 has its input terminals a, b, c and d connected respectively to output terminals P1, P2, N1 and N2 of a control circuit 5 which converts a DC voltage applied to terminals DC1 and DC2 into an alternate current. A signal is sent out from each of the output terminals P1, P2, N1 and N2 at timing to be described later. And the lighting circuit 7 has its output terminal e, which is for detecting tube currents in the cold cathode discharge lamps L1, L2 and L3, connected to an input terminal CN of the control circuit 5 which controls the tube currents in the cold cathode discharge lamps L1, L2 and L3 to predetermined values. The control circuit 5 is an LSI or microprocessor to convert a DC voltage applied to the terminals DC1 and DC2 into an AC voltage. Similarly, cold cathode discharge lamps L4, L5 and L6 are connected to another lighting circuit 7, which has its input terminals a, b, c and d connected respectively to the output terminals P1, P2, N1 and N2 of the control circuit 5, and which has its output terminal e connected to the input terminal CN of the control circuit 5.

Figure 6:
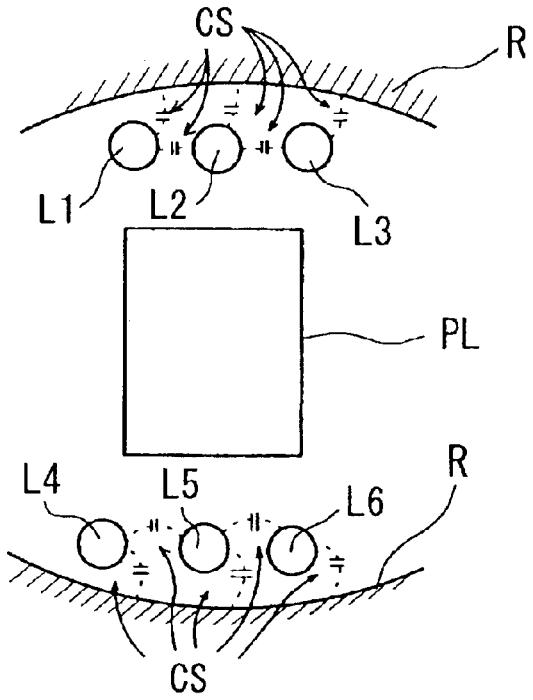
FIG. 6 is a schematic side view of a lighting device for a conventional liquid crystal display device.
Figure 7:
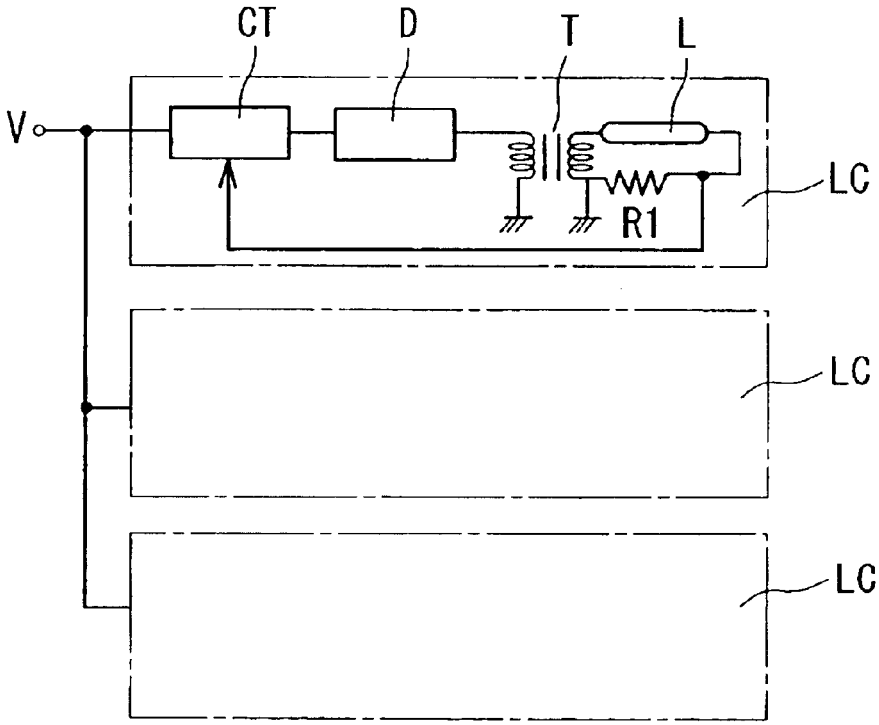
FIG. 7 is a block diagram of one conventional discharge lamp lighting device.
Figure 8:
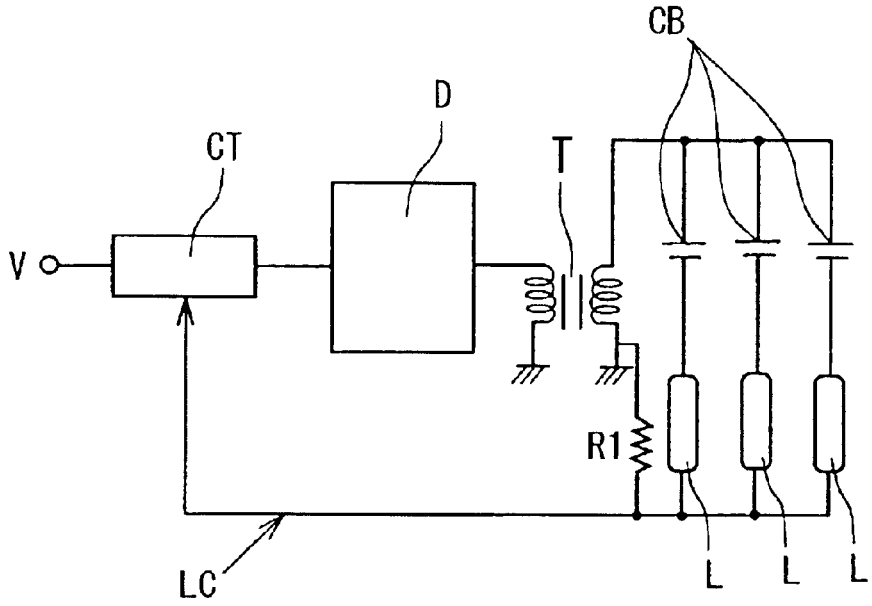
FIG. 8 is a block diagram of another conventional discharge lamp lighting device.
Figure 9:
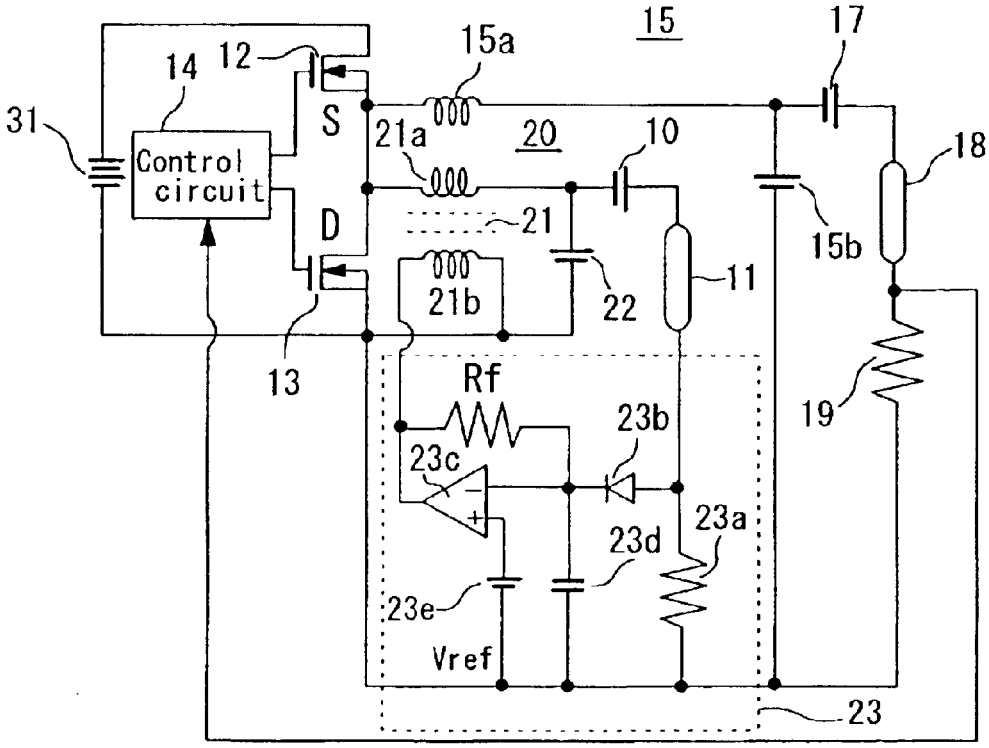
FIG. 9 is a circuit diagram of the conventional discharge lamp lighting device.

As discussed with reference to FIG. 6, the discharge lamp lighting device is structured such that light rays emitted from the cold cathode discharge lamps L1, L2, L3, L4, L5 and L6 are adapted to illuminate a liquid crystal display device by means of the reflectors R and the light guiding plate PL. In this connection, the cold cathode discharge lamps L1 to L6 are arranged such that the cold cathode discharge lamps L1, L2 and L3 are disposed in a line in this order along one reflector R facing one side of the light guiding plate PL, and the cold cathode discharge lamps L4, L5 and L6 are disposed in another line in this order along the other reflector R facing the other side of the light guiding plate PL opposite to the one side. The cold cathode discharge lamp L2 located centrally is connected to the output terminals j and k of the second leakage transformer T2, and the cold cathode discharge lamps L1 and L3 sandwiching the cold cathode discharge lamp L2 are connected respectively to the output terminals f and g, and h and i of the first leakage transformer T1. In the same way, the cold cathode discharge lamp L5 located centrally is connected to the output terminals j and k of the second leakage transformer T2, and the cold cathode discharge lamps L4 and L6 sandwiching the cold cathode discharge lamp L5 are connected respectively to the output terminals f and g, and h and i of the first leakage transformer T1.

The lighting circuit 7 will now be discussed. Referring to FIG. 4, in the first and second leakage transformers T1 and T2, their respective primary windings n1 and n1, and n3 in-phase with each other are connected to output terminals Q1 and Q2 of a well-known full-bridge circuit 6. The full-bridge circuit 6 has its four gate terminals G connected respectively to the output terminals P1, P2, N1 and N2 of the control circuit 5 via the input terminals a, b, c and d of the lighting circuit 7, respectively. In the full-bridge circuit 6, P-channel and N-channel FETs F1 and F3 are connected in cascade to each other, P-channel and N-channel FETs F2 and F4 are connected in cascade to each other, a connection between the FETs F1 and F2 constitutes an output terminal Q1, a connection between the FETs F3 and F4 constitutes an output terminal Q2, source terminals S of the FETs F1 and F2 are supplied with a DC power V, and source terminals S of the FETs F3 and F4 are grounded.

Also, in the first and second leakage transformers T1 and T2, their respective secondary windings n2 and n2, and n4 in-phase with each other have their one output terminals connected respectively to one terminals (hot terminals) of the cold cathode discharge lamps L1, L2 and L3, and have their other output terminals connected respectively to the other terminals (cold terminals) of the cold cathode discharge lamps L1, L2 and L3 via respective resistors RI. The connections between the other output terminals of the first and second leakage transformers T1 and T2 and the respective resistors RL are grounded, and the connections between the other output terminals (cold terminals) of the cold cathode discharge lamps L1, L2 and L3 and the respective resistors RL are connected to respective anode terminals of diodes D which have their cathode terminals connected to one another and further connected to the input terminal CN of the control circuit 5 via the output terminal e. The connection for the cold cathode discharge lamps L4, L5 and L6 is same as the connection above described.

The operation of the lighting circuit 7 shown in FIG. 4 will be described with respect to the side connected to the cold cathode discharge lamps L1, L2 and L3. Signals to apply prescribed driving signals to respective gate terminals G of the FETs of the full-bridge circuit 6 are outputted at the output terminals P1, P2, N1 and N2 of the control circuit 5, and two pairs of FETs conduct. Specifically, the FETs F1 and F4 conduct thereby causing a current to flow from the terminal Q1 to the terminal Q2, and alternately the FETs F2 and F3 conduct thereby causing a current to flow from the terminal Q2 to the terminal Q1. As a result, an AC signal (40 to 60 kHz) is caused to flow in the primary windings of the leakage transformers T1 and T2 whereby a predetermined voltage is generated at the secondary windings of the leakage transformers T1 and T2.

The AC signal generated by the full-bridge circuit 6 is applied in-phase to the primary windings n1 and n1 of the first leakage transformer T1 and the primary winding n3 of the second leakage transformer T2, and a voltage is outputted in-phase at the secondary windings n2 and n2 of the first leakage transformer T1 and the secondary winding n4 of the second leakage transformer T2. When the cold cathode discharge lamps L1, L3 and L2 are lighted by the voltage outputted, a tube current is caused to flow in the cold cathode discharge lamps. Then, only one diode conducts that is connected to a cold cathode discharge lamp in which the highest tube current flows. The highest tube current detected by the diode D is inputted to the input terminal CN of the control circuit 5, whereby respective tube currents flowing in the cold cathode discharge lamps L1, L3 and L2 are kept to be constant. The operation of the lighting circuit 7 with respect to the cold cathode discharge lamps L4, L5 and L6 is same and the explanation thereof will be omitted.

EXAMPLES

Examples, in which the cold cathode discharge lamps L1 to L6 are lighted by the discharge lamp lighting device of FIG. 4, will be described with reference to FIG. 5.

The numbers of turns on the primary and secondary windings n1 and n2 of the first leakage transformer T1 are 25 and 2400, respectively, the number of turns on the secondary winding n4 of the second leakage transformer T2 is 2400, and the number of turns on the primary winding n3 of the second leakage transformer T2 is 25 in a Coil 1 and 21 in a Coil 2.

In Wire connection 1, the cold cathode discharge lamp L3 located at one end of the reflector R is connected to the second leakage transformer T2, and the cold cathode discharge lamps L1 and L2 located at the other end and center of the reflector R are connected to the first leakage transformer T1, and in Wire connection 2, the cold cathode discharge lamp L2 is connected to the second leakage transformer T2, and the cold cathode discharge lamps L1 and L3 are connected to the first leakage transformer T1.

Phase difference 1 is a phase difference between the tube currents of the cold cathode discharge lamps L1, L2 and L3, and Phase difference 2 is a phase difference between the tube currents of the cold cathode discharge lamps L4, L5 and L6.

The Wire connection 2 is the embodiment of the present invention, and the Wire connection 1 is provided for comparison purpose. ILn (n: an integer) and Vopn (n: an integer) are a tube current and a tube voltage of a cold cathode discharge lamp Ln (n: an integer), respectively.

In FIG. 5, the least difference in tube current and the least phase difference in tube voltage between the cold cathode discharge lamps appear in the Wire connection 2 of the Coil 2, in which the cold cathode discharge lamp L2 located at the center of the reflector R is connected to the second leakage transformer T2, the cold cathode discharge lamp L1 and L3 located so as to sandwich the cold cathode discharge lamp L2 are connected to the first leakage transformer T1, and in which the number of turns on the primary winding n3 of the second leakage transformer T2 is 21.

The results shown in FIG. 5 can be generally expressed as follows. Tube currents flowing in three discharge lamps become equivalent to one another, when one discharge lamp lighted by a first leakage transformer is located between the other two discharge lamps lighted by a second leakage transformer, numbers of turns on primary windings of the first leakage transformer are identical with each other, numbers of turns on secondary windings of the first and second leakage transformers are identical with each other, and when the number of turns on the primary winding of the second leakage transformer is smaller than the number of turns on the primary winding of the first leakage transformer.

What is claimed is:

1. A discharge lamp lighting device comprising:

a plurality of discharge lamps;

at least one reflector to reflect light rays emitted from the discharge lamps; and at least one leakage transformer, each leakage transformer being adapted to light three discharge lamps and comprising: a first leakage transformer having two primary windings and two secondary windings structurally independent of the two primary windings, and adapted to light two discharge lamps of the three; and a second leakage transformer having a primary winding and a secondary winding structurally independent of the primary winding, and adapted to light remaining one discharge lamp of the three.

2. A discharge lamp lighting device according to claim 1, wherein the plurality of discharge lamps are disposed in parallel with one another, and the one discharge lamp lighted by the second leakage transformer is located between the two discharge lamps lighted by the first leakage transformer.

3. A discharge lamp lighting device according to claim 1, wherein the first and second leakage transformers are driven by a same driving circuit, and the three discharge lamps are lighted in-phase with one another.

4. A discharge lamp lighting device according to claim 1, wherein numbers of turns on the primary and secondary windings of the second leakage transformer are determined so as to equalize respective currents flowing in the three discharge lamps when the discharge lamps are lighted.

5. A discharge lamp lighting device according to claim 1, wherein numbers of turns on the two primary windings of the first leakage transformer are equal to each other, and numbers of turns on the two secondary windings of the first leakage transformer are equal to each other.

6. A discharge lamp lighting device according to claim 1, wherein the first leakage transformer comprises: a frame-core shaped substantially rectangular; and two bar-cores disposed parallel to each other and orthogonal to two opposing sides of the frame-core with a predetermined gap from the frame-core, each bar-core having a primary winding and a secondary winding structurally independent of the primary winding, and wherein the second leakage transformer comprises: a frame-core shaped substantially like square-U letter; and a bar-core disposed orthogonal to two opposing sides of the frame-core with a predetermined gap from the frame-core, and having a primary winding and a secondary winding structurally independent of the primary winding.

7. A discharge lamp lighting device according to claim 1, wherein the first leakage transformer comprises: a frame-core shaped substantially rectangular; and two bar-cores disposed parallel to each other and orthogonal to two opposing sides of the frame-core with a predetermined gap from the frame-core, each bar-core having a primary winding and a secondary winding structurally independent of the primary winding, and wherein the second leakage transformer comprises: a frame-core shaped substantially rectangular; and a bar-core disposed orthogonal to two opposing sides of the frame-core with a predetermined gap from the frame-core, and having a primary winding and a secondary winding structurally independent of the primary winding.

8. A discharge lamp lighting device according to claim 2, wherein numbers of turns on the two primary windings of the first leakage transformer are equal to each other, and numbers of turns on the two secondary windings of the first leakage transformer are equal to each other.

9. A discharge lamp lighting device according to claim 3 wherein numbers of turns on the two primary windings of the first leakage transformer are equal to each other, and numbers of turns on the two secondary windings of the first leakage transformer are equal to each other.

10. A discharge lamp lighting device according to claim 4, wherein numbers of turns on the two primary windings of the first leakage transformer are equal to each other, and numbers of turns on the two secondary windings of the first leakage transformer are equal to each other.

* * * * *